US008522574B2

(12) United States Patent
Crawford et al.

(10) Patent No.: US 8,522,574 B2
(45) Date of Patent: Sep. 3, 2013

(54) METHOD FOR NITROGEN REJECTION AND OR HELIUM RECOVERY IN AN LNG LIQUEFACTION PLANT

(75) Inventors: Duffer Crawford, Houston, TX (US); David Coyle, Houston, TX (US); Bharthwaj Anantharaman, Houston, TX (US)

(73) Assignee: Kellogg Brown & Root LLC, Houston, TX (US)

( * ) Notice: Subject to any disclaimer, the term of this patent is extended or adjusted under 35 U.S.C. 154(b) by 1006 days.

(21) Appl. No.: 12/347,085

(22) Filed: Dec. 31, 2008

(65) Prior Publication Data

US 2010/0162755 A1 Jul. 1, 2010

(51) Int. Cl.
*F25J 3/00* (2006.01)

(52) U.S. Cl.
USPC ..... 62/621; 62/617; 62/618; 62/619; 62/620; 62/622

(58) Field of Classification Search
USPC ..... 62/606, 611, 612, 613, 617, 618, 62/620, 621, 630
See application file for complete search history.

(56) References Cited

U.S. PATENT DOCUMENTS 3,360,946 A * 1/1968 Di Napoli ..... 62/621
3,543,528 A 12/1970 Crawford et al.
3,915,680 A * 10/1975 Crawford et al. ..... 62/630
4,415,345 A * 11/1983 Swallow ..... 62/630
4,435,198 A * 3/1984 Gray ..... 62/622
4,936,888 A * 6/1990 DeLong ..... 62/622
5,421,165 A * 6/1995 Paradowski et al. ..... 62/621
5,505,049 A * 4/1996 Coyle et al. ..... 62/619
5,692,395 A * 12/1997 Agrawal et al. ..... 62/630
5,893,274 A * 4/1999 Nagelvoort et al. ..... 62/613
6,014,869 A * 1/2000 Elion et al. ..... 62/621
6,070,429 A 6/2000 Low et al.
6,363,744 B2 * 4/2002 Finn et al. ..... 62/621
2002/0166336 A1 * 11/2002 Wilkinson et al. ..... 62/620
2004/0103687 A1 * 6/2004 Clare et al. ..... 62/621
2004/0177646 A1 * 9/2004 Wilkinson et al. ..... 62/614
2004/0231359 A1 * 11/2004 Brostow et al. ..... 62/623
2006/0230783 A1 * 10/2006 Clare et al. ..... 62/621
2007/0193303 A1 8/2007 Hawrysz et al.
2007/0245771 A1 * 10/2007 Spilsbury ..... 62/620
2007/0283718 A1 12/2007 Hulsey et al.

OTHER PUBLICATIONS

J-P. G. Jacks and J. C. McMillan, "Economic Removal of Nitrogen from LNG," Cryogenic Engineering Conference, Boulder, Colorado, Aug. 1977.

* cited by examiner

*Primary Examiner* — Frantz Jules
*Assistant Examiner* — Henry Crenshaw
(74) *Attorney, Agent, or Firm* — Gary M. Machetta

(57) ABSTRACT

Methods of reducing the concentration of low boiling point components in liquefied natural gas are disclosed. The methods involve dynamic decompression of the liquefied natural gas and one or more pre-fractionation vessels. Particular embodiments are suited for recovering helium and/or nitrogen enriched streams from a liquefied natural gas stream.

20 Claims, 5 Drawing Sheets

METHOD FOR NITROGEN REJECTION AND OR HELIUM RECOVERY IN AN LNG LIQUEFACTION PLANT

BACKGROUND

1. Field

The present embodiments generally relate to liquefied hydrocarbon fluids, and to methods and apparatus for processing such fluids. The present embodiments more particularly relate to the removal of components with low boiling points such as nitrogen and/or helium from a hydrocarbon stream being processed in a natural gas liquefaction plant.

2. Description of the Related Art

Natural gas is an important energy source that is obtained from subterranean wells, however, it sometimes contains impurities such as nitrogen and helium. In such situations, extraction of the impurities, such as nitrogen rejection, can be performed. Helium can also be present in natural gas, and can be separated for further processing in a helium recovery plant.

Raw natural gas contains primarily methane. It also can contain smaller amounts of ethane, propane, n-butane, isobutane, and heavier hydrocarbons, as well as water, nitrogen, helium, mercury, and acid gases such as carbon dioxide, hydrogen sulfide, and mercaptans.

Natural gas can be converted to liquefied natural gas (LNG) by cooling it to about −161° C., depending on its exact composition, which reduces its volume to about 1/600th of its volume at standard conditions. This reduction in volume can make transportation more economical. The liquefied natural gas (LNG) can be transferred to a cryogenic storage tank located on an ocean-going ship. The production of refrigeration needed to liquefy the natural gas is generally one of the highest expenses within a LNG liquefaction plant.

The presence of nitrogen in the LNG can increase the cost of transportation and decrease the heating value of the natural gas. A common solution to nitrogen contamination is the rejection of nitrogen. The stream containing the extracted nitrogen may contain hydrocarbons that may be used for purposes such as blending into a fuel gas stream.

Helium may be present in natural gas and can be recovered as a product. Helium may be separated from the natural gas utilizing methods that produce a helium enriched gas stream that can then be further processed in a helium recovery facility.

In light of the above, it is desirable to have an effective method to reduce the nitrogen concentration of an LNG stream, extract a helium enriched stream from said LNG stream, and reduce the refrigeration needs of the LNG liquefaction plant.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
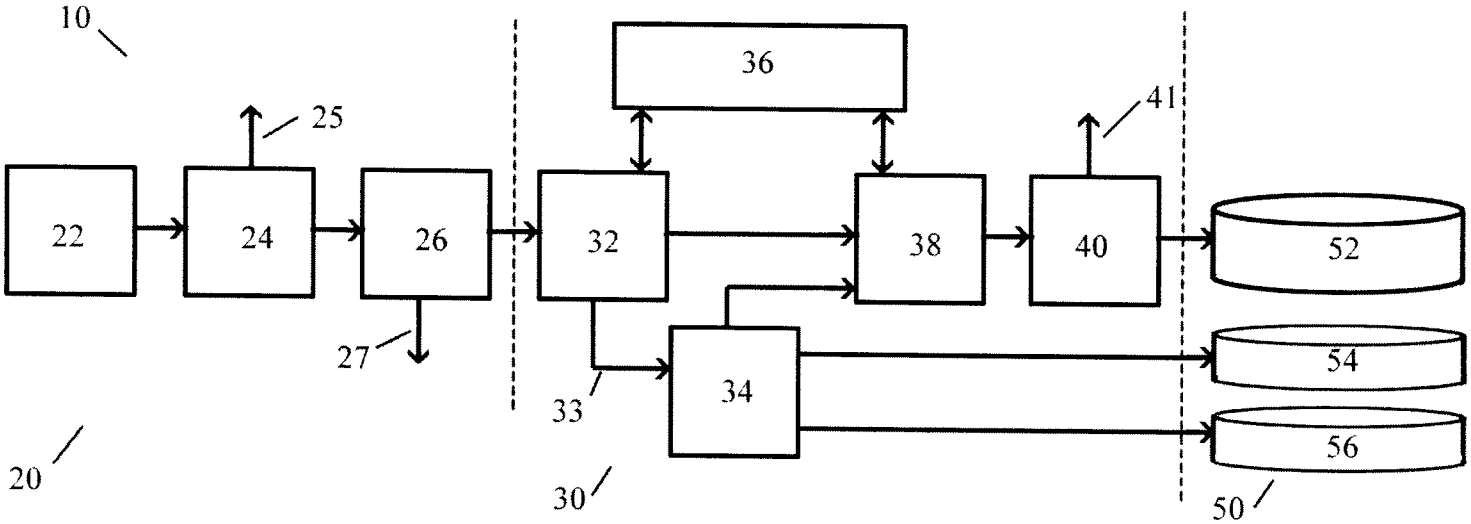
FIG. 1 illustrates a generalized LNG liquefaction plant block flow diagram that illustrates the major components of an overall LNG liquefaction facility.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art to make and use the inventions, when the information in this patent is combined with available information and technology.

An embodiment of the present invention is a method of reducing the nitrogen concentration in liquefied natural gas that includes passing an initial LNG stream through a first heat exchanger and a first liquid expander to reduce the temperature and dynamically decompress the LNG stream to obtain a first expanded LNG stream, decompressing the first expanded LNG stream in a second static liquid expander to obtain a second expanded LNG stream that contains a vapor phase, and passing the second expanded LNG stream to one or more pre-fractionation vessels for flash equilibrium separation to obtain one or more vapor streams that have increased concentration of nitrogen and a liquid stream that has a reduced concentration of nitrogen. The liquid stream that has a reduced concentration of nitrogen enters as feed to a fractionation column, withdrawing from an upper portion of the fractionation column a nitrogen enriched stream as compared to the feed to the fractionation column, and withdrawing from a lower portion of the fractionation column a LNG product stream that has a reduced concentration of nitrogen as compared to the initial LNG stream. At least a portion of one of the vapor or liquid streams from the one or more pre-fractionation vessels passes through the first heat exchanger to provide cooling to the initial LNG stream.

The method can also include dynamically decompressing at least one of the vapor streams from the one or more pre-fractionation vessels in one or more vapor expanders.

Yet another embodiment is a method of recovering helium and reducing the nitrogen concentration in liquefied natural gas by passing an initial LNG stream through a first heat exchanger and a first liquid expander to reduce the temperature and dynamically decompress the LNG stream to obtain a first expanded LNG stream. The first expanded LNG stream is decompressed in a second static liquid expander to obtain a second expanded LNG stream that contains a vapor phase. The second expanded LNG stream enters one or more helium flash drums for flash equilibrium separation to obtain a helium enriched vapor stream and a LNG stream that has reduced helium concentration. The LNG stream that has reduced helium concentration enters one or more pre-fractionation vessels for flash equilibrium separation to obtain a nitrogen enriched vapor stream and a liquid stream that has a reduced concentration of nitrogen. At least a portion of the vapor and liquid streams from the one or more pre-fractionation vessels enters a fractionation column where a nitrogen enriched vapor stream as compared to the feed to the fractionation column is withdrawn from an upper portion of the fractionation column and a LNG product stream that has a reduced concentration of nitrogen as compared to the initial LNG stream is withdrawn from a lower portion of the fractionation column. At least one of the vapor or liquid streams from the one or more pre-fractionation vessels pass through the first heat exchanger to provide cooling to the initial LNG stream.

There can be further processing of the helium enriched vapor stream in a helium recovery facility. The nitrogen enriched vapor stream can be utilized as fuel gas.

The method can further include dynamically decompressing at least one of the vapor streams from the one or more helium flash drums or the one or more pre-fractionation vessels in one or more vapor expanders. The method can further include passing the LNG stream that has reduced helium concentration through a second heat exchanger for cooling prior to entering the one or more pre-fractionation vessels, wherein at least one of the vapor or liquid streams from the one or more pre-fractionation vessels, the helium enriched vapor stream, or the nitrogen enriched vapor stream from the fractionation column pass through the second heat exchanger to provide cooling to the LNG stream that has reduced helium concentration prior to entering the one or more pre-fractionation vessels.

An alternate embodiment of the present invention includes an initial LNG stream at an initial liquefaction temperature and pressure. The initial LNG stream passes through a first heat exchanger and a first liquid expander to reduce the temperature and dynamically decompress the LNG stream to obtain a first expanded LNG stream that has a temperature and pressure less than or equal to the initial liquefaction temperature and pressure. The first expanded LNG stream is further decompressed in a second liquid expander to obtain a second expanded LNG stream that contains a vapor phase. The second expanded LNG stream enters a first pre-fractionation vessel for flash equilibrium separation to obtain a first vapor stream that has increased concentration of low boiling point components and a third liquid stream that has a reduced concentration of low boiling point components. At least a portion of one of the first vapor stream or third liquid stream from the pre-fractionation vessel passes through the first heat exchanger to provide cooling to the initial LNG stream. The first vapor stream and third liquid stream enter a fractionation column, from which a second vapor stream that has an increased concentration of low boiling point components as compared to the initial LNG stream is withdrawn and a fourth liquid stream that has a reduced concentration of low boiling point components as compared to the initial LNG stream is withdrawn.

The first pre-fractionation vessel can be capable of multistage pre-fractionation of the second expanded LNG stream. The fourth liquid stream can have nitrogen concentration of 1.5 mol % or less. The second vapor stream can provide cooling or "cold energy" to the initial LNG stream through the first heat exchanger. The second liquid expander can provide static expansion to obtain the second expanded LNG stream.

A portion of the fourth liquid stream can pass through the first heat exchanger to provide cold energy to the initial LNG stream prior to injection of the portion of the fourth liquid stream into the fractionation column. Such portion can also pass from the first heat exchanger to a subsequent pre-fractionation vessel for flash equilibrium separation into subsequent vapor and liquid streams prior to entering into the fractionation column.

A first vapor expander can be in fluid communication with the first pre-fractionation vessel and the fractionation column, wherein the first vapor expander decompresses the first vapor stream prior to injection into the fractionation column. The first vapor expander can provide dynamic expansion of the first vapor stream, which can then enter an upper portion of the fractionation column.

A second pre-fractionation vessel in fluid communication with and located after the first pre-fractionation vessel can be provided along with a third liquid expander in fluid communication with and located between the first pre-fractionation vessel and the second pre-fractionation vessel. The third liquid stream can be decompressed in the third liquid expander to obtain a fifth liquid stream that contains a vapor phase that enters the second pre-fractionation vessel for flash equilibrium separation to form a third vapor stream that has increased concentration of low boiling point components as compared to the fifth liquid stream and a sixth liquid stream that has a reduced concentration of low boiling point components as compared to the fifth liquid stream, the third vapor stream and the sixth liquid stream can then enter the fractionation column. The third liquid expander can provide static expansion to obtain the fifth liquid stream.

A second vapor expander can be provided in fluid communication with the second pre-fractionation vessel and the fractionation column, wherein the second vapor expander decompresses the third vapor stream prior to injection into the fractionation column. The second vapor expander can provide dynamic expansion of the third vapor stream.

A portion of the sixth liquid stream can flow through the first heat exchanger to provide cold energy to the initial LNG stream and obtain a seventh stream with a warmer temperature than the sixth liquid stream, which can enter the fractionation column. The seventh stream can provide vapor to the fractionation column needed to strip low boiling point components.

The method can further comprise providing a third pre-fractionation vessel in fluid communication with the second pre-fractionation vessel, flowing the seventh stream to the third pre-fractionation vessel for flash equilibrium separation to obtain a fourth vapor stream that has increased concentration of low boiling point components as compared to the sixth liquid stream and an eighth liquid stream that has a reduced concentration of low boiling point components as compared to the sixth liquid stream, and flowing the fourth vapor stream and the eighth liquid stream into the fractionation column.

The eighth liquid stream can enter a lower portion of the fractionation column. The fourth vapor stream can provide vapor to the fractionation column needed to strip low boiling point components.

The method can further include providing a first helium flash drum in fluid communication with and located before the first pre-fractionation vessel, passing the second expanded LNG stream containing vapor to the first helium flash drum for flash equilibrium separation to obtain a first helium enriched vapor stream and a first helium reduced liquid stream, and providing a fourth liquid expander in fluid communication with and located between the first helium flash drum and the first pre-fractionation vessel, and decompressing the first helium reduced liquid stream in the fourth liquid expander prior to entering the first pre-fractionation vessel. The fourth liquid expander can provide static expansion to the first helium reduced liquid stream prior to the first pre-fractionation vessel.

In some embodiments at least 40% of the helium contained in the initial LNG stream is extracted and contained or present in the first helium enriched vapor stream. The first helium enriched vapor stream can pass through the first heat exchanger to provide cold energy to the initial LNG stream.

The first helium flash drum can be capable of multi-stage flash equilibrium separation to obtain at least one helium enriched vapor stream and at least one helium reduced liquid stream.

The method can further include a third vapor expander in fluid communication with the first helium flash drum which decompresses the first helium enriched vapor stream prior to the first heat exchanger. The third vapor expander can provide dynamic expansion of the first helium enriched vapor stream.

A second heat exchanger can be in fluid communication with and located between the first helium flash drum and the fourth liquid expander that cools the first helium reduced liquid stream by cross exchange with the first helium enriched vapor stream. The second vapor stream can flow through the second heat exchanger to provide cold energy to the first helium reduced liquid stream. A portion of the sixth liquid stream can flow through the second heat exchanger prior to the first heat exchanger, to provide cold energy to the first helium reduced liquid stream.

The method can also include providing a third heat exchanger in fluid communication with and located between the second pre-fractionation vessel and the fractionation column that can cool the third vapor stream by heat exchange with the first helium enriched vapor stream. At least a portion of the first helium enriched vapor stream can be passed through the third heat exchanger to provide cold energy to the third vapor stream prior to the third vapor stream entering the fractionation column.

The method can also include a second helium flash drum in fluid communication with and located between the first helium flash drum and the fourth liquid expander, and a fifth liquid expander in fluid communication with and located between the first helium flash drum and the second helium flash drum. The first helium reduced liquid stream can be decompressed in the fifth liquid expander to obtain a second helium reduced liquid stream that contains a vapor phase. The second helium reduced liquid stream can enter the second helium flash drum for flash equilibrium separation to form a second helium enriched vapor stream that has increased concentration of helium as compared to the first helium reduced liquid stream and a third helium reduced liquid stream that has a reduced concentration of helium as compared to the first helium reduced liquid stream. The second helium enriched vapor stream can be combined with the first helium enriched vapor stream, and the third helium reduced liquid stream can flow through the second heat exchanger and the fourth liquid expander prior to flowing into the first pre-fractionation vessel. The fifth liquid expander can provide static expansion to obtain the second helium reduced liquid stream.

With reference to the figures, FIG. 1 illustrates a generalized LNG liquefaction plant block flow diagram is shown that illustrates the major components of an overall LNG liquefaction facility 10 such as a gas treating section 20, a liquefaction/refrigeration section 30, and an LNG send out and storage section 50. A gas treating section 20 can comprise gas reception facilities 22, acid gas removal unit 24, a dehydration/mercury removal unit 26. The liquefaction section 30 can comprise an initial cooling/condensing unit 32 to remove heavier hydrocarbons, liquid removal with fractionation 34, liquefaction 38, refrigeration system 36, and endflash/nitrogen rejection unit 40. An LNG send-out and storage section 50 can comprise storage for the LNG 52, LNG/LPG 54, and heavier hydrocarbon liquids 56 that are sometimes referred to as gasoline. The acid gas removal unit 120 can remove hydrogen sulfide, carbon dioxide, and other impurities via line 25. The dehydration/mercury removal unit 26 can remove water and mercury as illustrated via line 27. The endflash/nitrogen rejection unit 40 can remove nitrogen as illustrated via line 41. In some facilities a helium-rich stream is also produced for further processing in a helium plant. It is common to remove a portion of the nitrogen from the LNG before transportation. In some embodiments of the process, the natural gas after treatment can have a maximum nitrogen concentration of 1 mol %.

Modifying heating value of the LNG at the liquefaction facility may include adding or extracting ethane, propane and butane (LPG) and also may include the removal of nitrogen. There is the possibility of producing two or more product qualities of differing heating values and differing compositions.

Figure 2:
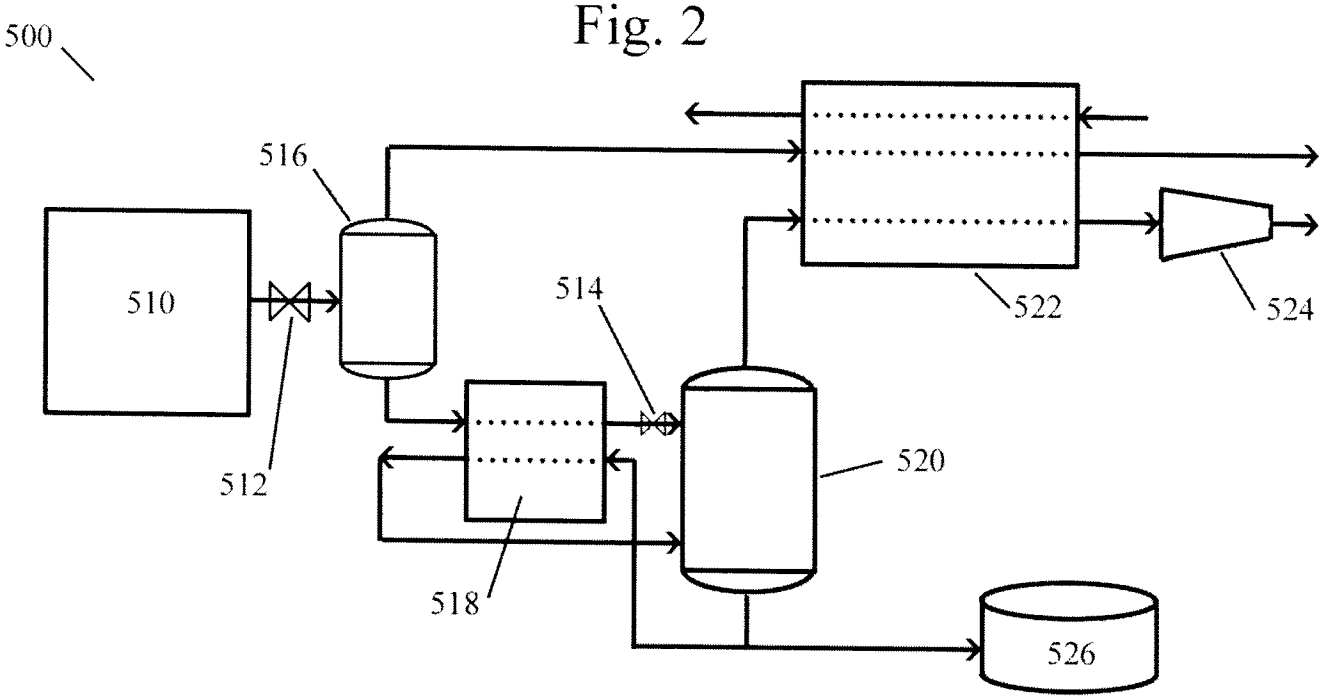
FIG. 2 illustrates one embodiment where an endflash section can remove nitrogen from LNG.

FIG. 2 illustrates an endflash section 500 that can remove nitrogen from an LNG stream that is known in the prior art. After liquefaction of the natural gas at high pressure in the liquefaction section 510, the LNG pressure can be reduced, such as through one or more static expanders 512, 514 to approximately atmospheric pressure before entering the storage tanks 526. This minimizes flash vapor generation in the tank that would have to be recompressed by a boil off gas compressor. An endflash 500 can be used if the nitrogen concentration in the LNG is above about 1%. The endflash 500 also can remove methane with the nitrogen that can be returned to the fuel gas system by re-pressurizing it to a fuel gas pressure. The endflash section 500 can comprise a flash drum 516 and/or a re-boiled, trayed column 520 for more extensive nitrogen removal. The column 520 can concentrate the nitrogen and reduce the methane loss from the LNG. The vapor can be routed through an exchanger 522 to recover some of the cold energy before being compressed in the fuel gas compressor 524. Column 520 can also be a flash drum instead of a trayed column.

Figure 3:
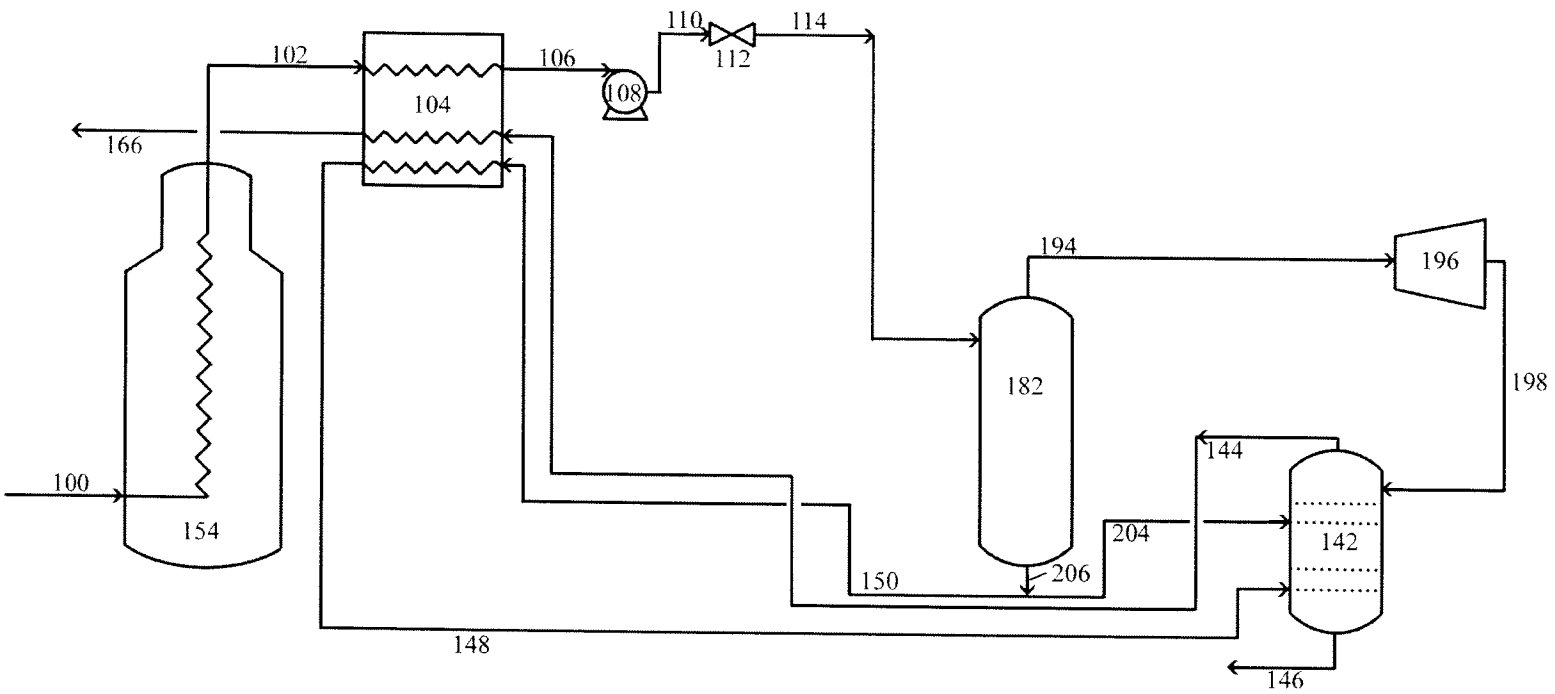
FIG. 3 illustrates an embodiment that is a process for nitrogen and/or helium rejection in an LNG liquefaction plant.

Referring to FIG. 3, one embodiment of the present invention is a back end flash process for separating N2 from liquefied natural gas utilizing one or more flash drums and vapor expansion in conjunction with a fractionation column that can be used as a nitrogen stripper column. The process begins with any method of cooling and liquefaction of the feed gas stream 100, generally involving a cryogenic heat exchanger 154. The cooled and liquefied stream containing nitrogen and possibly other light components exits exchanger 154 as LNG stream 102.

Stream 102 passes through a first heat exchanger 104, in which stream 102 is cooled to form stream 106 due to refrigeration from the cold streams 144 and 150. The stream 106 exiting the first heat exchanger 104 is expanded dynamically in a first liquid expander 108, thereby reducing the pressure and the single-phase liquid expanded stream 110 can be further reduced in pressure by static expansion by a liquid expander 112, such as a J-T valve, to form stream 114.

The first liquid expander can be a turbine or turbo-expander or other apparatus suitable for dynamically expanding liquid. Generally the liquid expander is operated under conditions to keep the LNG stream in a liquid form to avoid two phases within the expander.

In an alternate embodiment the first liquid expander 108 can be located before the first heat exchanger 104. The first liquid expander 108 and the first heat exchanger 104 are in fluid communication with each other and are located between the cryogenic heat exchanger 154 and the static liquid expander 112 regardless of their configuration relative to each other.

Stream 114 undergoes a flash equilibrium separation in the first flash drum 182 to form a first vapor stream 194 and a liquid stream 206.

In one embodiment of the present invention the first vapor stream 194 from the flash drum will contain the majority of the nitrogen present in the LNG stream 102, and such embodiments may contain at least 60%, at least 70%, at least 80%, at least 90%, or up to 95% or greater of the nitrogen present in the LNG stream 102.

The first vapor stream 194 exiting the first flash drum 182 is passed through a first vapor expander 196 reducing the pressure and temperature for stream 198 that is fed to an upper section of the fractionation column 142, such as the first tray.

The nitrogen-rich vapor stream 144 from the fractionation column 142 passes through the first heat exchanger 104 and is warmed to become the nitrogen-rich product stream 166. The nitrogen-rich product stream 166 can be used for fuel gas in that it will have a component of natural gas that has heating value. The nitrogen-rich product stream 166 can be referred to as a nitrogen-rich fuel gas stream or simply as a fuel gas stream.

Liquid stream 206 leaving the first flash drum 182 can be divided into streams 150 and 204. Liquid stream 204 is an optional stream that is fed directly to the fractionation column 142 to be stripped of nitrogen. The flow through liquid stream 204 can vary from zero up to a majority of the liquid stream 206 and can be varied to adjust the flow rate of stream 150 and can be used to minimize the duty on the fractionation column 142.

Stream 150 flows through the first exchanger 104 where it is heated to form a partially vaporized stream 148 and enters the fractionation column 142 as a side stream vapor feed to provide a portion of the vapor needed for nitrogen stripping or to function as a reboiler to the fractionation column 142 and provide a heated stream to the lower portion of the fractionation column 142.

The LNG product stream 146 exiting the fractionation column 142 is a resulting blend of the liquid portions of the various streams entering the fractionation column 142 and has a reduced N2 mole fraction compared to the LNG stream 102 prior to the process. A portion of the LNG product stream 146 can flow through the first exchanger 104 where it is heated to form a partially vaporized stream and returned to the fractionation column 142 to function as a reboiler and provide a heat source to the lower portion of the fractionation column 142.

Figure 4:
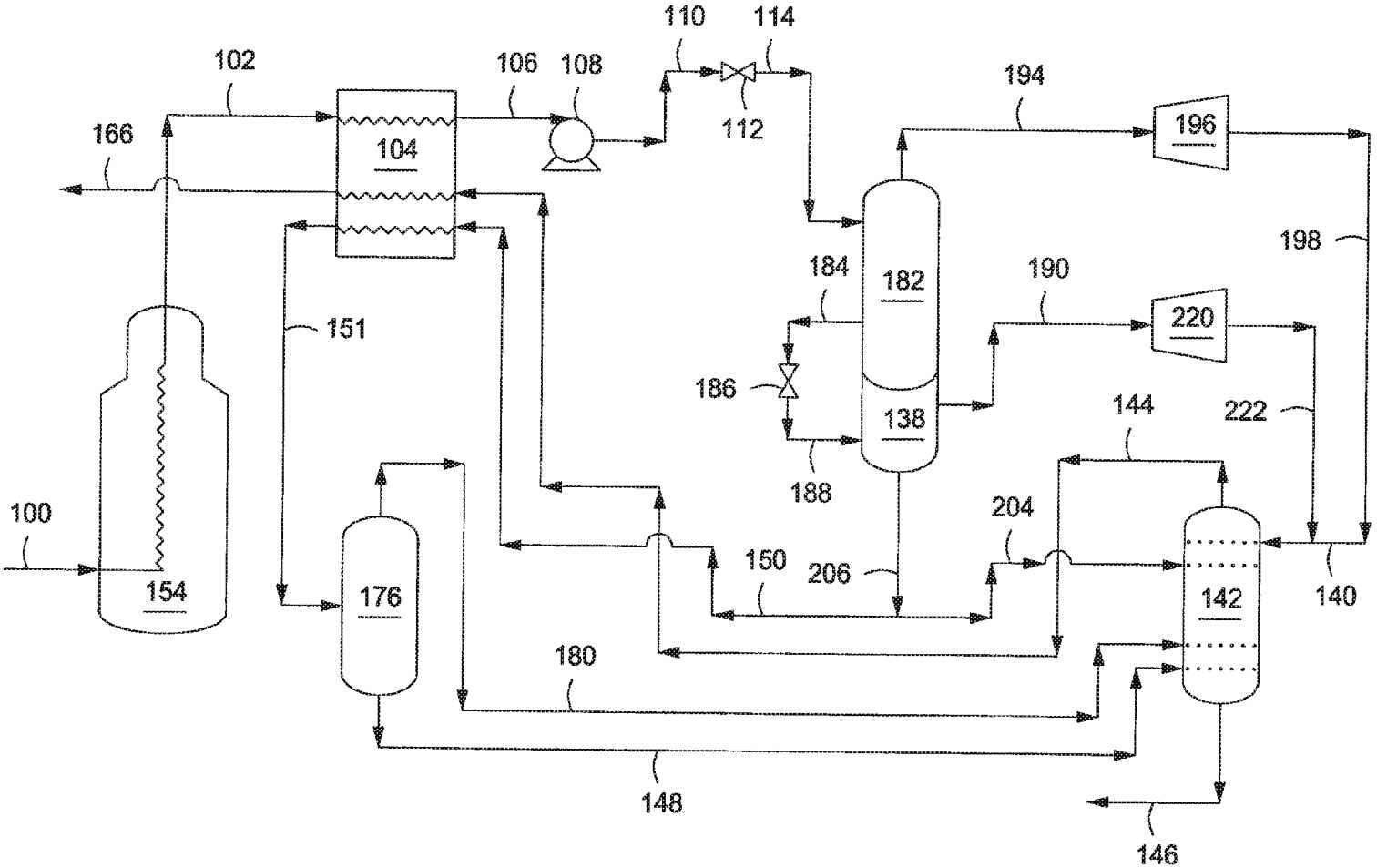
FIG. 4 illustrates an embodiment that is a process for nitrogen and/or helium rejection in an LNG liquefaction plant.

Referring to FIG. 4, one embodiment of the present invention is a back end flash process for separating N2 from liquefied natural gas utilizing one or more flash drums and vapor expansion in conjunction with a fractionation column that can be used as a nitrogen stripper column. The process begins with any method of cooling and liquefaction of the feed gas stream 100, generally involving a cryogenic heat exchanger 154. The cooled and liquefied stream containing nitrogen and possibly other light components exits exchanger 154 as LNG stream 102.

Stream 102 passes through a first heat exchanger 104, in which stream 102 is cooled to form stream 106 due to refrigeration from the cold streams 144 and 150. The stream 106 exiting the first heat exchanger 104 is expanded dynamically in a first liquid expander 108, thereby reducing the pressure and the single-phase liquid expanded stream 110 can be further reduced in pressure by static expansion by a liquid expander 112, such as a J-T valve, to form stream 114.

The first liquid expander can be a turbine or turbo-expander or other apparatus suitable for dynamically expanding liquid. Generally the liquid expander is operated under conditions to keep the LNG stream in a liquid form to avoid two phases within the expander.

In an alternate embodiment the first liquid expander 108 can be located before the first heat exchanger 104. The first liquid expander 108 and the first heat exchanger 104 are in fluid communication with each other and are located between the cryogenic heat exchanger 154 and the static liquid expander 112 regardless of their configuration relative to each other.

Stream 114 undergoes a flash equilibrium separation in the first flash drum 182 to form a vapor stream 194 and a liquid stream 184. The liquid steam 184 from the bottom of the first flash drum 182 passes through liquid expander 186 with reduction in pressure forming stream 188, which is fed to a second flash drum 138. The second flash drum 138 can be adjacent to the first flash drum 182 as shown in FIG. 3 or can be a separate vessel. The vapor from the second flash drum 138 is stream 190 and the liquid from the second flash drum 138 is stream 206.

In one embodiment of the present invention the vapor streams from the first and second flash drums, streams 194 and 190 respectively, will contain the majority of the nitrogen present in the LNG stream 102, and such embodiments may contain at least 60%, at least 70%, at least 80%, at least 90%, or up to 95% or greater of the nitrogen present in the LNG stream 102.

The vapor stream 194 exiting the first flash drum 182 is passed through a first vapor expander 196 reducing the pressure and temperature for stream 198. The vapor stream 190 exiting the second flash drum 138 is passed through a second vapor expander 220 reducing the pressure for stream 222. The first and second vapor expanders 196, 220 can be in a parallel arrangement with each expanding the vapor streams from the first and second flash drums 182, 138. Vapor stream 198 can be joined with vapor stream 222 forming a combined stream 140. It is desirable that line 140 be of sufficient length and/or mixing capability to obtain a thorough mixing of the streams 198 and 222. The mixed stream 140 is fed to an upper section of the fractionation column 142, such as the first tray. The combination of streams 198 and 222 can be a 2-phase feed stream that provides a portion of cold liquid reflux to column 142.

The nitrogen-rich vapor stream 144 from the fractionation column 142 passes through the first heat exchanger 104 and is warmed to become the nitrogen-rich product stream 166. The nitrogen-rich product stream 166 can be used for fuel gas in that it will have a component of natural gas that has heating value. The nitrogen-rich product stream 166 can be referred to as a nitrogen-rich fuel gas stream or simply as a fuel gas stream.

Liquid stream 184 from the first flash drum 182 goes through static liquid expander 186 to form a two-phase stream 188 that is separated into vapor and liquid portions in a second flash drum 138. Liquid stream 206 leaving the second flash drum 138 can be divided into streams 150 and 204. Liquid stream 204 is an optional stream that is fed directly to the fractionation column 142 to be stripped of nitrogen. The flow through liquid stream 204 can vary from zero up to a majority of the liquid stream 206 and can be varied to adjust the flow rate of stream 150 and can be used to minimize the duty on the fractionation column 142.

Although the embodiment shown in FIG. 3 contains two flash drums 182, 138 in series used for the removal of nitrogen, alternate embodiments of the invention may have a single flash drum or may have more than two flash drums that are used for this purpose.

Stream 150 flows through the first exchanger 104 where it is heated and enters an optional third flash drum 176 where liquid and vapor phases are separated. The vapor leaving the third flash drum 176 as stream 180 enters the fractionation column 142 as a side stream vapor feed and provides a portion of the vapor needed for nitrogen stripping. The liquid leaving the third flash drum as stream 148 enters the fractionation column 142 at the lower portion of the column. In various embodiments the first exchanger 104 can function as a reboiler to the fractionation column 142 through the heating of stream 150 that becomes streams 180 and 148 and provide heated streams to the lower portion of the fractionation column 142.

The LNG product stream 146 exiting the fractionation column 142 is a resulting blend of the liquid portions of the various streams entering the fractionation column 142 and has a reduced N2 mole fraction compared to the LNG stream 102 prior to the process.

Figure 5:
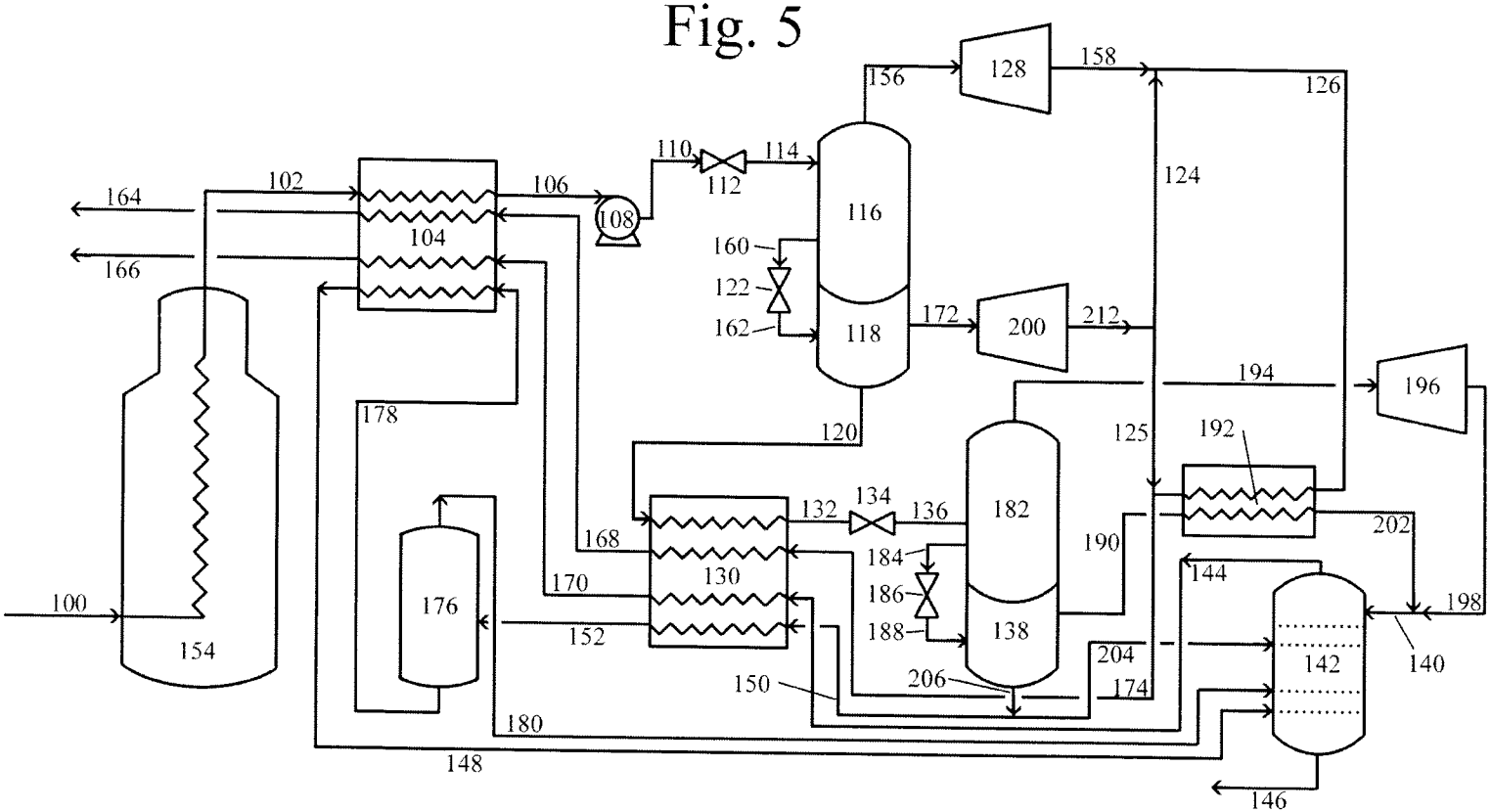
FIG. 5 illustrates an embodiment that is a process for nitrogen rejection and/or helium recovery in an LNG liquefaction plant.

Referring to FIG. 5, one embodiment of the present invention is a back end flash process for separating Helium from natural gas in double He flash drums, removing N2 from natural gas in flash drums and a fractionation column, and sending the LNG product from a fractionation column to storage. The process begins with any method of cooling and liquefaction of the feed gas stream 100, generally involving a cryogenic heat exchanger 154. The cooled and liquefied stream containing nitrogen and helium exits exchanger 154 as LNG stream 102.

Stream 102 passes through a first heat exchanger 104, in which stream 102 is cooled to form stream 106 due to refrigeration from the cold streams 168, 170 and 178 exiting as steams 164, 166 and 148 respectively from the first heat exchanger 104. The stream 106 exiting the first heat exchanger 104 is expanded dynamically in a first liquid expander 108, thereby reducing the pressure and the single-phase liquid expanded stream 110 can be further reduced in pressure by static expansion by a liquid expander 112, such as a J-T valve, to form stream 114.

The first liquid expander can be a turbine or turbo-expander or other apparatus suitable for dynamically expanding liquid. Generally the liquid expander is operated under conditions to keep the LNG stream in a liquid form to avoid cavitations within the expander.

Stream 114 undergoes a flash equilibrium separation in the first flash drum 116 to form a vapor stream 156 and a liquid stream 160. The liquid steam 160 from the bottom of the first flash drum passes through the static liquid expander 122 with reduction in pressure forming stream 162, which is fed to a second flash drum 118. The second flash drum 118 can be adjacent to the first flash drum 116 as shown or can be a separate vessel. The vapor from the second flash drum 118 is stream 172 and the liquid from the second flash drum 118 is stream 120.

Although the embodiment shown in FIG. 4 contains two flash drums 116, 118 used for the removal of helium, alternate embodiments of the invention may have a single flash drum or may have more than two flash drums that are used for the removal of helium.

In one embodiment of the present invention the vapor streams from the first and second flash drums, streams 156 and 172 respectively, will contain the majority of the helium present in the LNG stream 102, and in embodiments will contain at least 60%, at least 70%, at least 80%, at least 90%, or up to 95% or more of the helium present in the LNG stream 102.

The vapor stream 156 exiting the first flash drum 116 is passed through a first vapor expander 128 reducing the pressure and temperature for stream 158. The vapor stream 172 exiting the second flash drum 118 is passed through a second vapor expander 200 reducing the pressure for stream 212, which can flow as needed to either stream 124 or stream 125 depending on the temperature of stream 212 to optimize the operation of the exchangers 192, 130 and 104.

Any cold energy from stream 212 that is not used or needed in exchanger 192 can be used in either exchanger 130 via stream 174 and/or exchanger 104 via stream 168. Cold energy supplied to exchanger 104 can enable a higher temperature for LNG stream 102 that can reduce the cooling duty on the cryogenic heat exchanger 154 thus reducing the refrigeration duty and expense for the LNG liquefaction facility.

Vapor stream 158 can be joined with vapor stream 124 forming a combined stream 126, which feeds to a third heat exchanger 192 and is warmed (by supplying refrigeration to stream 190) and combined with stream 125 to form stream 174 that is a helium enriched stream. Stream 174 is then heated in a second heat exchanger 130 to form stream 168 and the cold energy utilized to cool stream 120, and can be further warmed in the first heat exchanger 104 to form stream 164 and the cold energy utilized to cool stream 102. The helium-rich stream 164 can then be sent for further processing, typically to a helium recovery plant.

The liquid stream 120 exiting the second flash drum 118 passes through the second heat exchanger 130 and is cooled to form stream 132; refrigeration is derived from cold streams 174, 144 and 150, which exit as streams 168, 170 and 152 respectively. The liquid stream 132 is further cooled to form stream 136 by flashing across static liquid expander 134.

Two-phase stream 136 enters a third flash drum 182 where the liquid and vapor phases separate. The vapor stream 194 passes through a third vapor expander 196 and the expanded vapor stream 198 is mixed with the partially condensed stream 202 exiting the third heat exchanger 192 to form stream 140. It is desirable that line 140 be of sufficient length and/or mixing capability to obtain a thorough mixing of the streams 198 and 202. The mixed liquid and vapor stream 140 is fed to an upper section of the fractionation column 142, such as the first tray. The combination of streams 198 and 202 making up the 2-phase feed stream 140 can provide a portion of cold reflux to column 142.

Liquid stream 184 from the third flash drum 182 goes through static liquid expander 186 to form a two-phase stream 188 that is separated into vapor and liquid portions in a fourth flash drum 138. Vapor leaves the fourth flash drum 138 as stream 190 and is cooled in the third heat exchanger 192 to form stream 202. Liquid stream 206 leaving the fourth flash drum 138 can be divided into streams 150 and 204. Liquid stream 204 is an optional stream that is fed directly to the fractionation column 142 to be stripped of nitrogen. The flow through liquid stream 204 can vary from zero up to a majority of the liquid stream 206 and can be varied to optimize the operation of the fractionation column 142. Stream 150 enters the third exchanger 130 and warms to form stream 152 and utilizes some of its cold energy to cool stream 120.

Stream 152 can enter a fifth flash drum 176 where the liquid and vapor phases are separated. The vapor leaving the fifth flash drum 176 as stream 180 and entering fractionation column 142, as a side stream vapor feed, supplies a portion of the vapor needed to strip the nitrogen and minimizes the required amount of vapor to be created in stream 148. The liquid leaves the fifth flash drum as stream 178 and is further heated in the first heat exchanger 104 to form stream 148 and utilizes some of its cold energy to cool stream 102. Stream 148 enters a lower portion of the fractionation column 142 and can supply a portion of the vapor needed to strip the nitrogen.

The nitrogen-rich vapor stream 144 from the fractionation column 142 passes through the second heat exchanger 130 and is warmed to become stream 170 and utilizes some of its cold energy to cool stream 120. Stream 170 from the second heat exchanger outlet enters the first heat exchanger 104 and is further warmed to become the nitrogen-rich product stream 166 and utilizes some of its cold energy to cool stream 102. The nitrogen-rich product stream 166 can be used for fuel gas in that it will have a component of natural gas that has heating value. The nitrogen-rich product stream 166 can be referred to as a nitrogen-rich fuel gas stream or simply as a fuel gas stream.

The helium that is not removed in the first and second flash drums 116, 118 will be removed from the LNG stream with the nitrogen removal process in the third or fourth flash drums 182, 138 and/or the fractionation column 142 and be a component of the nitrogen-rich fuel gas product stream 166. Both the nitrogen-rich fuel gas and helium-rich products, streams 166 and 164 respectively, are generally below the temperature of LNG stream 102 as they leave this process and can be used for further refrigeration duties.

In one embodiment of the invention one or both of the first heat exchanger 104 and the second heat exchanger 130 function as a reboiler for the fractionation column 142.

The LNG product stream 146 exiting the fractionation column 142 is a combination of the liquid portions of the various streams entering the fractionation column 142 has a reduced N2 mole fraction than the LNG stream 102 prior to the process. In one embodiment the N2 mole fraction of the LNG product stream 146 is less than 2%, in alternate embodiments the N2 mole fraction of the LNG product stream 146 is less than 1%; or less than 0.5%; or less than 0.25%.

Benefits of the improved design can be significant, because the process utilizes refrigeration that is produced at temperatures below the conventional practice. The use of flash drums 182, 138 and the partial vaporization of the liquid stream 150 may reduce the liquid flow within the fractionation column substantially, in some embodiments by at least 40%; at least 50%; at least 60%; at least 70%; or more. This process takes place where temperatures are the lowest in the LNG process, and refrigeration produced can result in significant power savings. Typically, the temperature of stream 102 can be raised when compared to conventional practice. As the temperature of LNG stream 102 can be raised, there are significant savings realized within the LNG refrigeration system.

Some particular features of the improvement are optimizing the pre-fractionation that can be achieved by partial vaporization of the nitrogen column feed, the use of multiple flash pressures, the ability to reduce the liquid traffic within the fractionation column, and the capability to optimize the column stripping vapor flow ratios.

The quantity of product that is vaporized within the process can generally range from about 1% to about 15% of the LNG stream 102. In certain embodiments of the present invention the quantity of product that is vaporized within the process can range from about 5% to about 10% of the LNG stream 102 as determined by fuel requirements.

Not all of the possible embodiments of the present invention are shown in the figures. The following list is provided as an aid to interpretation of FIGS. 3, 4 and 5, but are not to be limiting in their interpretation: first heat exchanger (104); second heat exchanger (103); third heat exchanger (192); first liquid expander (108); second liquid expander (112); third liquid expander (186); fourth liquid expander (134); fifth liquid expander (122); first vapor expander (196); second vapor expander (220); fractionation column (142); first pre-fractionation vessel (182); second pre-fractionation vessel (138); third pre-fractionation vessel (176); first vapor stream (194); second vapor stream (144); third vapor stream (190); fourth vapor stream (180); first flash drum for Helium removal (116); second flash drum for Helium removal (118); first helium enriched vapor stream (156); second helium enriched vapor stream (172); first helium reduced liquid stream (160); second helium reduced liquid stream (162); and second helium reduced liquid stream (120).

Various terms are used herein, to the extent a term used is not defined herein, it should be given the broadest definition persons in the pertinent art have given that term as reflected in printed publications and issued patents. Depending on the context, all references herein to the "invention" may in some cases refer to certain specific embodiments only. In other cases it may refer to subject matter recited in one or more, but not necessarily all, of the claims.

As used herein, "cold energy" is defined to mean the capacity of a first stream to cool a second stream by the flow of thermal energy from the warmer second stream to the colder first stream. The transfer of cold energy from a first stream to a second stream shall mean that thermal energy flows from the second stream to the first stream resulting in the first stream being warmed while the second stream is cooled.

As used herein, "liquid expander" is defined to mean an apparatus capable of imposing a controlled decrease in pressure to a liquid stream. Non-limiting examples of a liquid expander can include a static expander such as a valve and a dynamic expander such as a turbine. The liquid expander can create a two-phase stream by the partial vaporization of the liquid stream.

As used herein, "parallel" or "parallel arrangement" is defined to mean that the components are not arranged in series and that each component separately processes a portion of the stream. As such, the components do not have to be aligned in a true physical parallel manner with respect to each other.

As used herein, "between" is defined to mean that the components are arranged in series process flow rather than parallel process flow and that the component referred to is situated after the process flow through one of the reference items and before the process flow through the other reference item. As such, the components do not have to be aligned in a particular physical location with respect to each other.

Certain embodiments and features have been described using a set of numerical upper limits and a set of numerical lower limits. It should be appreciated that ranges from any lower limit to any upper limit are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, the term should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. A method of reducing the concentration of components having low boiling points in liquefied natural gas comprising:

providing an initial LNG stream at an initial liquefaction temperature and pressure;

passing the initial LNG stream through a first heat exchanger and a first liquid expander to reduce the temperature and dynamically decompress the LNG stream to obtain a first expanded LNG stream;

decompressing the first expanded LNG stream in a second liquid expander to obtain a second expanded LNG stream containing a vapor phase;

passing the second expanded LNG stream to a first pre-fractionation vessel for flash equilibrium separation to obtain a first vapor stream and a first liquid stream;

decompressing the first vapor stream in a first vapor expander to produce an expanded first vapor stream;

introducing the expanded first vapor stream to a fractionation column, wherein the expanded first vapor stream is introduced to an upper section of the fractionation column;

decompressing the first liquid stream in a third liquid expander to obtain a second liquid stream comprising a vapor phase;

separating the second liquid stream in a second pre-fractionation vessel for flash equilibrium separation to provide a second vapor stream and a third liquid stream;

introducing the second vapor stream and the third liquid stream to the fractionation column;

withdrawing a third vapor stream as an overhead from the fractionation column;

withdrawing from a lower portion of the fractionation column a fourth liquid stream;

passing at least a portion of the third vapor stream through the first heat exchanger to cool the initial LNG stream;

passing at least a portion of the third liquid stream through the first heat exchanger to cool the initial LNG stream and then to a third pre-fractionation vessel for flash equilibrium separation into a fourth vapor stream and a fifth liquid stream; and introducing the fourth vapor stream and the fifth liquid stream to the fractionation column.

2. The method of claim 1, further comprising providing a second vapor expander in fluid communication with the second pre-fractionation vessel and the fractionation column, wherein the second vapor expander dynamically decompresses the second vapor stream to obtain an expanded second vapor stream.

3. The method of claim 2, further comprising:

mixing the expanded first vapor stream and the expanded second vapor stream to obtain an expanded mixed vapor stream; and introducing the expanded mixed vapor stream to the upper section of the fractionation column.

4. The method of claim 1, wherein the fourth vapor stream provides vapor to the fractionation column needed to strip low boiling point components.

5. The method of claim 1, wherein the first and second pre-fractionation vessels are flash drums.

6. The method of claim 1, wherein the first and second pre-fractionation vessels do not contain trays.

7. The method of claim 1, wherein at least a portion of the first or second vapor streams passes through the first heat exchanger to cool the initial LNG stream.

8. The method of claim 7, wherein the third liquid stream is introduced to an upper portion of the fractionation column.

9. The method of claim 1, wherein the third vapor stream is nitrogen enriched.

10. The method of claim 1, wherein the fourth vapor stream and the fifth liquid stream are introduced to a lower portion of the fractionation column.

11. The method of claim 1, wherein the initial LNG stream comprises nitrogen, and wherein the first vapor stream and the second vapor stream each comprise at least 60 wt % of the nitrogen present in the initial LNG stream.

12. The method of claim 1, wherein the initial LNG stream comprises nitrogen and wherein the first vapor stream and the second vapor stream each comprise at least 95 wt % of the nitrogen present in the initial LNG stream.

13. The method of claim 1, wherein the fourth vapor stream and the fifth liquid stream are introduced to the fractionation column at a location below where the third liquid stream is introduced to the fractionation column.

14. A method of reducing the concentration of components having low boiling points in liquefied natural gas comprising:

passing an initial LNG stream through a first heat exchanger and a first liquid expander to reduce the temperature and dynamically decompress the LNG stream to obtain a first expanded LNG stream;

decompressing the first expanded LNG stream in a second liquid expander to obtain a second expanded LNG stream containing a vapor phase;

introducing the second expanded LNG stream to a first pre-fractionation vessel for flash equilibrium separation to obtain a first vapor stream and a first liquid stream;

decompressing the first vapor stream in a first vapor expander to obtain an expanded first vapor stream;

introducing the expanded first vapor stream to a fractionation column;

decompressing the first liquid stream in a third liquid expander to obtain a second liquid stream comprising a vapor phase;

separating the second liquid stream in a second pre-fractionation vessel for flash equilibrium separation to provide a second vapor stream and a third liquid stream;

decompressing the second vapor stream in a second vapor expander to obtain an expanded second vapor stream;

mixing the expanded first vapor stream and the expanded second vapor stream to obtain an expanded mixed vapor stream;

introducing the expanded mixed vapor stream to the upper section of the fractionation column;

introducing the third liquid stream to the fractionation column;

withdrawing a third vapor stream as an overhead from the fractionation column;

withdrawing a fourth liquid stream from a lower portion of the fractionation column;

passing at least a portion of the third vapor stream through the first heat exchanger to cool the initial LNG stream;

passing at least a portion of the third liquid stream through the first heat exchanger and to a third pre-fractionation vessel for flash equilibrium separation into a fourth vapor stream and a fifth liquid stream; and introducing the fourth vapor stream and the fifth liquid stream to the fractionation column.

15. The method of claim 14, wherein the first, second, and third pre-fractionation vessels are flash drums.

16. The method of claim 14, wherein the initial LNG stream comprises nitrogen, and wherein the first vapor stream and the second vapor stream each comprise at least 60 wt % of the nitrogen present in the initial LNG stream.

17. The method of claim 14, wherein the initial LNG stream comprises nitrogen and wherein the first vapor stream and the second vapor stream each comprise at least 95 wt % of the nitrogen present in the initial LNG stream.

18. A method of reducing the concentration of components having low boiling points in liquefied natural gas comprising:

passing an initial LNG stream through a first heat exchanger and a first liquid expander to reduce the temperature and dynamically decompress the LNG stream to obtain a first expanded LNG stream;

decompressing the first expanded LNG stream in a second liquid expander to obtain a second expanded LNG stream containing a vapor phase;

introducing the second expanded LNG stream to a first flash drum to obtain a first vapor stream and a first liquid stream;

decompressing the first vapor stream from the first flash drum in a first vapor expander to obtain an expanded first vapor stream;

introducing the expanded first vapor stream to a fractionation column;

decompressing the first liquid stream in a third liquid expander to obtain a second liquid stream comprising a vapor phase;

separating the second liquid stream in a second flash drum to provide a second vapor stream and a third liquid stream;

decompressing the second vapor stream in a second vapor expander to obtain an expanded second vapor stream;

mixing the expanded first vapor stream and the expanded second vapor stream to obtain an expanded mixed vapor stream;

introducing the expanded mixed vapor stream to the upper section of the fractionation column;

introducing a first portion of the third liquid stream to the fractionation column;

passing a second portion of the third liquid stream through the first heat exchanger and to a third flash drum to obtain a fourth vapor stream and a fifth liquid stream;

introducing the fourth vapor stream and the fifth liquid stream to a lower portion of the fractionation column;

withdrawing a third vapor stream as an overhead from the fractionation column;

withdrawing a fourth liquid stream from the lower portion of the fractionation column; and passing at least a portion of the third vapor stream through the first heat exchanger to cool the initial LNG stream.

19. The method of claim 18, wherein the initial LNG stream comprises nitrogen, and wherein the first vapor stream and the second vapor stream each comprise at least 60 wt % of the nitrogen present in the initial LNG stream.

20. The method of claim 18, wherein the initial LNG stream comprises nitrogen and wherein the first vapor stream and the second vapor stream each comprise at least 95 wt % of the nitrogen present in the initial LNG stream.

* * * * *